US009457591B1

(12) United States Patent
LeFevre et al.

(10) Patent No.: US 9,457,591 B1
(45) Date of Patent: Oct. 4, 2016

(54) ANTI-CONTAMINATION COATING FOR DECURLER INDENTING SHAFT

(71) Applicant: XEROX CORPORATION, Norwalk, CT (US)

(72) Inventors: Jason Matthew LeFevre, Penfield, NY (US); Santokh Badesha, Pittsford, NY (US); David VanKouwenberg, Avon, NY (US); Varun Sambhy, Pittsford, NY (US); Eric Dudek, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/841,096

(22) Filed: Aug. 31, 2015

(51) Int. Cl.

| | |
|---|---|
| ***B65H 29/70*** | (2006.01) |
| ***B41J 2/01*** | (2006.01) |
| ***B41J 11/00*** | (2006.01) |
| ***B05D 1/18*** | (2006.01) |

(52) U.S. Cl.
CPC ..... *B41J 11/0005* (2013.01); *B05D 1/18* (2013.01)

(58) Field of Classification Search
CPC ..... B65H 29/00; B65H 29/70; G03G 15/00; B41J 11/0005; B05D 1/18
USPC ..... 399/406
See application file for complete search history.

(56) References Cited

U.S. PATENT DOCUMENTS 5,364,697 A * 11/1994 Miyabayashi ..... C08K 9/04 118/60
7,897,678 B2 * 3/2011 Qiu ..... C08G 18/2885 524/507
8,192,005 B2 * 6/2012 Law ..... B41J 11/057 347/103
8,544,987 B2 10/2013 Sambhy et al.
2008/0008838 A1 * 1/2008 Arpac ..... C08G 18/3812 427/386
2011/0122210 A1 * 5/2011 Sambhy ..... C09D 183/04 347/101
2012/0039648 A1 * 2/2012 Sambhy ..... G03G 15/2057 399/333

(Continued)

FOREIGN PATENT DOCUMENTS

JP 01267255 A * 10/1989 ..... B65H 29/70
JP 07196224 A * 8/1995 ..... G03G 15/00

(Continued)

OTHER PUBLICATIONS

Sambhy et al., "Anti-Wetting, Low Adhesion Coatings for Aqueous Ink Printheads," U.S. Appl. No. 14/535,874, filed Nov. 7, 2014.

*Primary Examiner* — Nguyen Ha
*Assistant Examiner* — 'Wyn' Ha
(74) *Attorney, Agent, or Firm* — MH2 Technology Law Group LLP

(57) ABSTRACT

Provided is a printing apparatus that includes: a sheet path for moving a print substrate; a decurling station positioned along the sheet path and the decurling station. The decurling station includes an indenting roller mounted for rotation around a first longitudinal axis thereof and on a first side of the sheet path, and an elastomeric roller mounted for rotation around a second longitudinal axis thereof and on a second side of the sheet path. The indenting roller includes an indenter shaft and a an anti-contamination coating disposed on the indenter shaft, wherein a drop of aqueous ink exhibits a sliding angle of less than about 30° and a contact angle of greater than about 40° with a surface of the anti-contamination coating.

20 Claims, 6 Drawing Sheets

(56) References Cited

U.S. PATENT DOCUMENTS

2012/0062666 A1* 3/2012 Roof ..... B41M 7/0081 347/102
2012/0062667 A1* 3/2012 Roof ..... B41J 11/0015 347/102
2012/0156510 A1* 6/2012 Okafuji ..... C09D 171/02 428/446
2012/0314012 A1* 12/2012 Roof ..... B41J 11/002 347/102
2013/0084458 A1* 4/2013 Yamada ..... B82Y 30/00 428/421
2013/0096254 A1* 4/2013 Sambhy ..... C08G 18/5015 524/590

FOREIGN PATENT DOCUMENTS

JP 2009235151 A * 10/2009 ..... C08F 229/02
WO WO 2015142558 A1 * 9/2015 ..... C08K 3/36

* cited by examiner

ANTI-CONTAMINATION COATING FOR DECURLER INDENTING SHAFT

TECHNICAL FIELD

Embodiments described herein relate generally to decurling devices, including image-forming devices, such as printers, copiers, and similar imaging apparatus that incorporate such devices and methods of making decurling devices.

BACKGROUND

Curl may be induced into sheets of paper due to various handling factors and this may impair the further handling of the sheets. One way in which curl unintentionally is induced in sheets is in the process of transfer and fixing of an image to a sheet in a photocopier. This can particularly be a problem in a duplex copier where the sheet is to be conveyed to a duplex buffer tray from which it is re-fed to the photoreceptor to receive an image on its other side. It may also be a problem where the sheet requires a further processing such as binding in a finisher.

It is often necessary to remove curl from a material in order to process in the material more easily. For example, devices that transport sheets of media (such as copiers, printers, multifunction machines, etc.) often benefit from very flat, de-curled sheets, which reduce the occurrence of jamming and other malfunctions. Similarly, when ribbons or webs of material are unwound from rolls, they may contain a certain amount of curl that needs to be removed.

Various sheet curl control apparatus have been devised. For example, one arrangement of a decurler comprises a pair of co-acting rollers—that is, a feeding roller and an indenting shaft—that form a nip therebetween (note that sometimes rollers are referred to as rolls). One of the rollers is more elastic (softer) than the other roller. Pressure is applied between the rollers to form what is referred to as a "nip" and the material to be curled or de-curled is fed through the nip to have the curl removed or added.

When print media, such as ink, is deposited as a print image on a substrate, such as a sheet of paper, down-curl can be induced on the printed sheet by the image. In particular, this is problematic when a solid stripe of ink is printed on the lead-edge of a sheet. During the de-curling process, the indenting shaft can be placed facing the ink and in contact with the sheet. As a result, the indenting shaft is susceptible to ink contamination as ink from the sheet transfers from the sheet to a surface of the indenting shaft. If ink buildup on the indenting shaft persists, it may cause the sheet to wrinkle in the decurler. Additionally, any ink that deposits on the indenting shaft may be re-deposited on other portions of the same sheet, creating an unacceptable "ink offset" print defect, or as artifacts on subsequent sheets. A decurler that overcomes the limitations described above would be a welcome addition to the art.

SUMMARY

In an embodiment there is a printing apparatus that includes: a sheet path for moving a print substrate; a decurling station positioned along the sheet path. The decurling station includes an indenting roller mounted for rotation around a first longitudinal axis thereof and on a first side of the sheet path, and an elastomeric roller mounted for rotation around a second longitudinal axis thereof and on a second side of the sheet path. The indenting roller includes an indenter shaft and a an anti-contamination coating disposed on the indenter shaft, wherein a drop of aqueous ink exhibits a sliding angle of less than about 30° and a contact angle of greater than about 40° with a surface of the anti-contamination coating.

In another embodiment, there is a method of making an indenting roller of a decurling device. The method includes providing an anti-contamination coating solution; depositing the anti-contamination coating on a surface of an indenter shaft; and curing the anti-contamination coating deposited on the surface of the indenter shaft, wherein a drop of aqueous ink exhibits a sliding angle of less than 30° and a contact angle of greater than 40° with a surface of the cured anti-contamination coating.

In another embodiment there is an indenting roller, comprising: an indenter shaft and a an anti-contamination coating disposed on a surface of the indenter shaft, wherein a drop of aqueous ink exhibits a sliding angle of less than about 30° and a contact angle of greater than about 40° with a surface of the anti-contamination coating.

Advantages can include one or more of the following: increases the ink limit which can be allowed for papers that are a stress case for ink contamination and/or ink offset; provides for ink jet treated papers to be printed using higher ink loading resulting in a more vibrant print; and reduces decurler contamination (and/or ink offset) in the cases when the decurler shaft is indenting any additional amount exceeding a nip (NVM=0).

Additional advantages of the embodiments will be set forth in part in the description which follows, and in part will be understood from the description, or may be learned by practice of the embodiments. The advantages will be realized and attained by means of the elements and combinations particularly pointed out in the appended claims.

It is to be understood that both the foregoing general description and the following detailed description are exemplary and explanatory only and are not restrictive of the embodiments, as claimed.

BRIEF DESCRIPTION OF THE DRAWINGS

The accompanying drawings, which are incorporated in and constitute a part of this specification, illustrate embodiments of the present teachings and together with the description, serve to explain the principles of the disclosure.

DESCRIPTION OF THE EMBODIMENTS

Figure 1A:
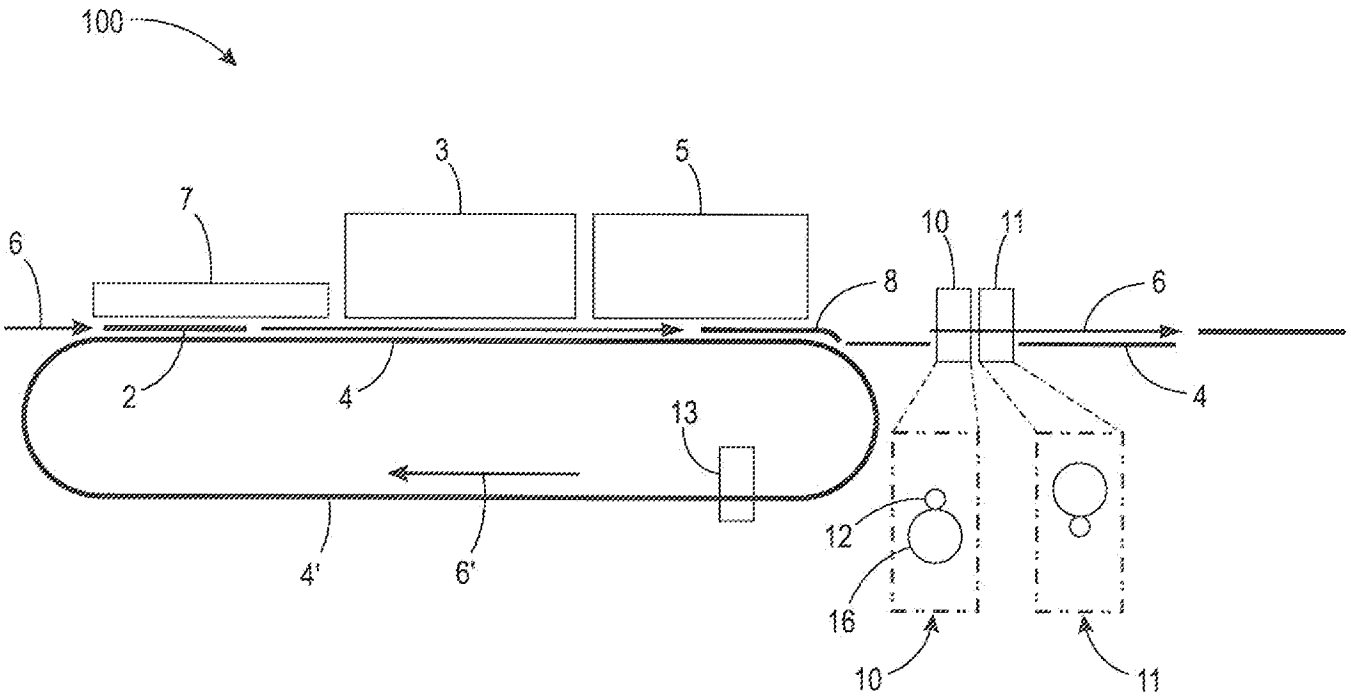
FIG. 1A is a side-view schematic diagram of a printing apparatus that includes an inset showing general details of a decurling device according to an embodiment.

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

The following embodiments are described for illustrative purposes only with reference to the Figures. Those of skill in the art will appreciate that the following description is exemplary in nature, and that various modifications to the parameters set forth herein could be made without departing from the scope of the present embodiments. It is intended that the specification and examples be considered as examples only. The various embodiments are not necessarily mutually exclusive, as some embodiments can be combined with one or more other embodiments to form new embodiments.

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "print substrate" refers to a tangible medium, such as paper (e.g., a sheet of paper, a long web of paper, a ream of paper, etc.), transparencies, parchment, film, fabric, plastic, paperboard, or other substrates on which an image can be printed or disposed.

As used herein, the terms "roll" and "roller" are used interchangeably to describe a rotating member with a rounded outer surface.

As used herein, the terms "layer" and "coating" (noun) are used interchangeably to describe a material that is disposed, either directly or indirectly, on a substrate.

It will be understood that the structures depicted in the figures may include additional features not depicted for simplicity, while depicted structures may be removed or modified.

Embodiments described herein include those directed to anti-contamination coatings and printing apparatus having indenting stations for removing curl from print-substrate on which a printed image, such as that formed by printing thereon with aqueous inks, is deposited. When an indenting roller of a decurling station is coated with an anti-contamination coating as described, ink, such as aqueous ink, deposited on print substrate surprisingly exhibits low adhesion and sufficiently low wettability towards the surface of the anti-contamination coating as determined, for example, by sliding angle and contact angle. Contamination of the indenter roller may also be surprisingly reduced. Embodiments also include indenting rollers that exhibit reduced adhesion between aqueous ink and the indenting roller, as well as methods of making an indenting roller.

FIG. 1A illustrates a print within an apparatus 100 that travels along a sheet path 4 in a processing direction 6 (which could be reversed in some embodiments). An image may be printed on print substrate 2 at marker station 3 and may be subsequently dried in dryer station 5 along the path 4. As a result, the print substrate may become curled (as shown by curl 8). In the case of a simplex paper path, the curled print substrate 2 may continue on sheet path 4 into an upstream decurler 10. The upstream decurler 10 may include a relatively smaller radius, relatively harder roller 12 that may include an indenting shaft 14 such as metal (steel) shaft that may be at least partially coated with a perfluoropolyether derivative-based polymer anti-contamination coating 15. The roller 12 may be configured to be spaced apart from or engaged by a relatively larger, relatively larger softer 16 for example having a compressible rubber surface. The rollers 12 and 16 may be moved together to form a nip where the two rollers contact one another and through which a print substrate may be transported. The print substrate 2 may continue on sheet path 4 into a downstream decurler 11. In the case of a duplex paper path, the curled print substrate may be caused to move through a duplex decurler and in direction 6' along duplex sheet path 4' prior to entering a registration station 7 and continuing through apparatus as described above.

Figure 1B:
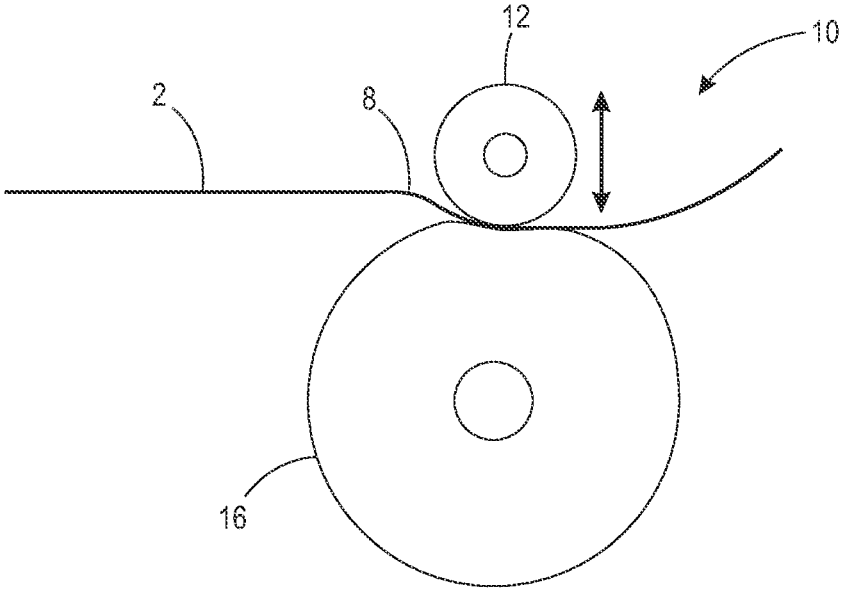
FIG. 1B is a zoomed in side-view schematic diagram of the decurling device depicted in the inset of FIG. 1A.

As shown in FIG. 1B, the printing apparatus transports the print substrate between the relatively smaller and harder roller 12 and a relatively larger and softer roller 16. In the embodiments herein, smaller and harder roller 12 is sometimes referred to herein as the "first," "indenter" or "penetrating" roller, while softer and larger roller 16 is sometimes referred to as the "second," "idler" or "elastomeric" roller". The softer roller 16 may comprise a conformable rubber layer such that it may deform when the harder roller 12 is driven into the softer roller 16. If the print substrate 2 travels along the print path within the nip between the softer roller 16 and the harder roller 12, this causes the substrate 2 to indent around the harder roller 12, thereby removing the curl 8 or curvature within the substrate 2 if sufficient pressure is applied. In other words, the harder roller 12 may contact the softer roller 12, "indenting" some distance into the conformable, softer roller 16 and thus inducing more decurling of the print substrate.

Figure 2A:
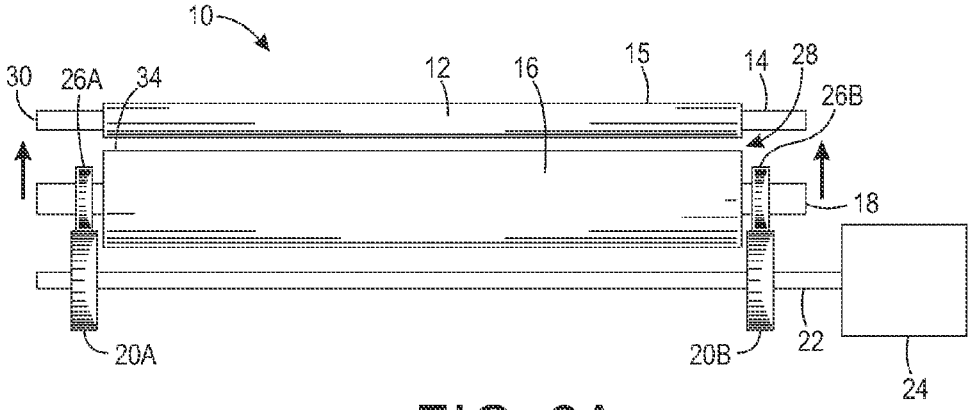
FIG. 2A illustrates a front elevation view of a decurler device according to an embodiment of the present disclosure having a first roller and a second roller disengaged from one another.
Figure 2B:
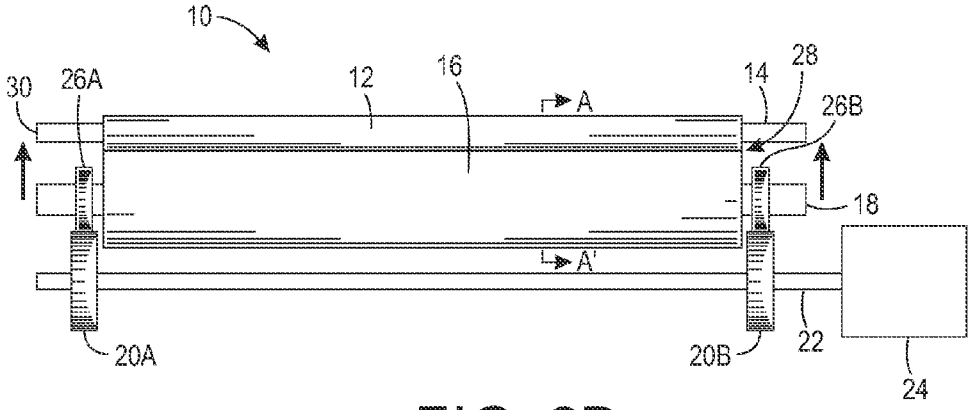
FIG. 2B illustrates a front elevation view of a decurler device according to an embodiment of the present disclosure having a first roller and a second roller engaged with one another.

Turning to FIGS. 2A-2B, an indenter roller 12 is mounted on an axle 30 comprising indenter shaft 14 and is rotatable with the indenter shaft 14 around a longitudinal axis. As shown, the indenter shaft 14 alone performs as an axle 30 for the indenter roller, but embodiments are not so limited and the indenter shaft may itself be mounted on a separate axle. The indenter shaft 14 may be driven by an independent motor (not shown). An opposing elastomeric roller 16 is mounted on an axle 18 and is likewise rotatable with the axle 18 around a longitudinal axis. Elastomeric roller 16 and axle 18 are further optionally driven by a motor 24 instead of or in addition to a rotational force driving the axle 14 of the indenter roller 12. Likewise, indenter roller 12 may be driven by a separate motor instead of or in addition to the rotational force driving the axle 18 of roller 16.

The axle 18 is mounted to translate in a direction transverse to the axis of the indenter roller 12, in this case vertically, to bring a surface 34 the elastomeric roll 16 into engagement with the indenter roller 12 (as described above). In one embodiment, one or more cams 20*a*, 20*b* may be mounted on an axle 22 and may rotate with the axle 22. The axle 22 is in turn driven by a actuator 24, in this example a stepper motor, to position and hold the cams 20*a*, 20*b*, which act on the axle 18 through cam followers 26*a*, 26*b*, formed thereon, which are in this case embodied as collars on the axle 18. Alternately or additionally, the motor 24 may comprise a servo motor, or a hybrid motor, or a fluid-powered motor. It will also be appreciated that optionally the cams may be moved linearly rather than or in addition to rotationally. Within the range of motion of the elastomeric roll 16, and space 28 may be formed to admit a print substrate, for example print substrate 2 (as in FIG. 1B), which may be a cut sheet of paper. The space 28 may be closed so the indenter roller 12 presses against a surface of and/or indents the body of the elastomeric roller 16, as illustrated, for example, in FIG. 2B and FIG. 2C.

Figure 2C:
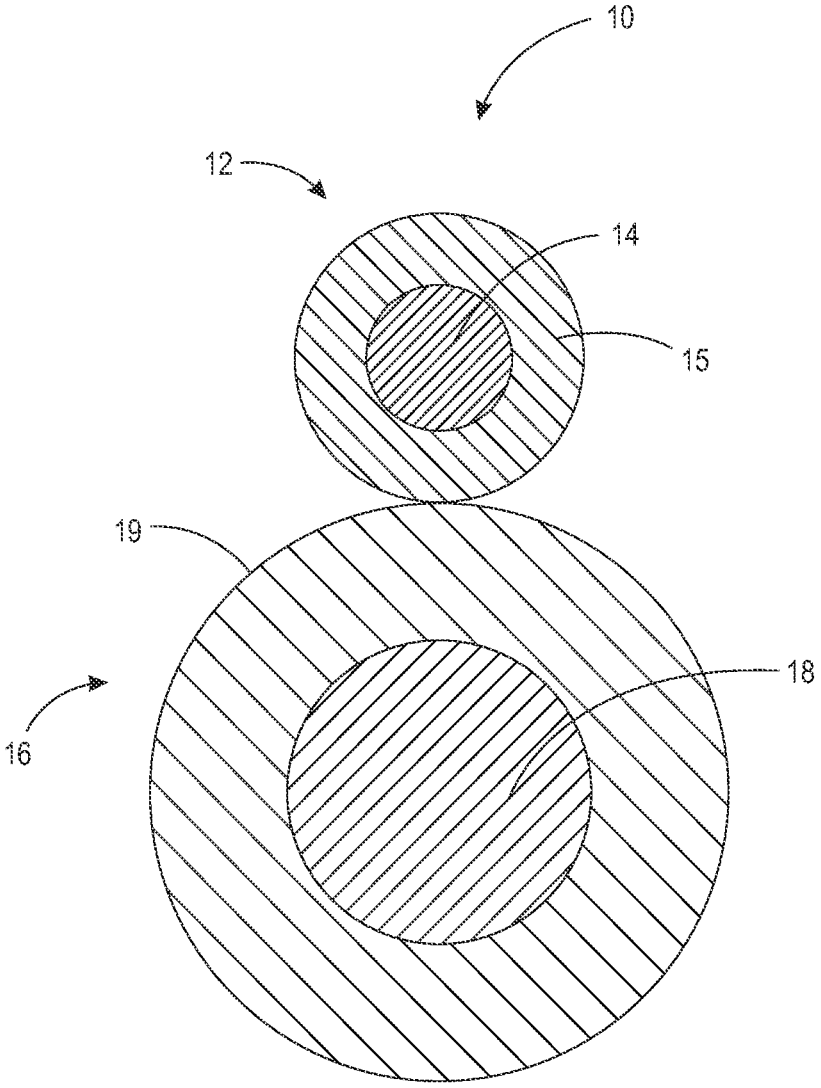
FIG. 2C illustrates an axial cross-section view taken along line A-A' of FIG. 2B.

FIG. 2C illustrates a detailed view of the indenter roller 12 engaged with the elastomeric roller 16. The first roller, that is, the indenter roller 12, may comprise an indenting shaft 14, which may at least be partially coated with an anti-contamination coating 15. The anti-contamination coating 15 may have a thickness of about 1 μm to about 50 μm, for example from about 3 μm to about 10 μm, including from about 10 μm to about 25 μm.

The second roller, that is, the elastomeric roller 16 may include axle 18 which may include a layer of a material that is softer than the axle 14 and/or coating 15. For example, elastomeric roller 16 may include elastomer layer 19 disposed over a surface of axle 18. Additional layers (not shown) may be disposed between elastomer layer 19 and axle 18, or on a surface of elastomer layer 19.

Properties of Anti-Contamination Coatings

The anti-contamination coatings described herein, which may be used with decurling stations of, for example, aqueous ink jet, printers, such as in upstream decurling stations, allow for jetted drops of aqueous ink to exhibit anti-wetting, low adhesion towards the anti-contamination coating. The adhesion of an aqueous ink drop towards a surface can be determined by measuring a sliding angle of the aqueous ink drop, where the sliding angle is a angle at which the surface is inclined relative to a horizontal position when the aqueous ink drop on the surface begins to slide over the surface without leaving residue or stain behind. The lower the sliding angle is, the lower the adhesion between the aqueous ink drop and the surface is expected to be.

The phrase "low adhesion" as used herein means a low sliding angle of about 35° or less when measured with aqueous inks, with the anti-contamination coating deposited on an indenter shaft of an indenter roller. In some embodiments, a low sliding angle is about 30° or less. In other embodiments, the low sliding angle is about 25° or less or about 20° or less when measured with aqueous inks with a surface of the anti-contamination coating of the decurling device indenting roller. In yet other embodiments, a low sliding angle is about 1° or greater when measured with aqueous inks, with a surface of the anti-contamination coating of the decurling device indenting roller.

The anti-contamination coating described herein can also exhibit a "sufficiently low wettability" with respect to the aqueous inks that are deposited on print-substrates, such as paper, when a contact angle between the ink and the low adhesion coating is, in one embodiment, about 40° or greater and in another embodiment is about 55° or greater. In some embodiments, jetted drops of aqueous ink exhibit a contact angle of about 65° or greater. In one embodiment, there is no upper limit to the contact angle exhibited between the jetted drops of aqueous inks and the surface coating. In another embodiment, the jetted drops of aqueous ink exhibit a contact angle of about 150° or less.

In some embodiments, the high contact angle and non-wetting properties of the anti-contamination coatings described herein are retained even against aqueous inks containing surfactants. Due to the presence of surfactants, aqueous inks tend to wet most surfaces, even hydrophobic, high water contact angle surfaces. This is a surprising and beneficial property of the embodiments of the anti-contamination coatings described herein.

In other embodiments, a contact angle of about 40° or greater is observed even when the coating surface is fouled with, for example, dry aqueous ink. Further, the anti-wetting, low adhesion surface coating can have a long performance life, such as the ability to maintain performance after being submerged in 40° C. ink for up to 2 days.

In embodiments, the anti-wetting, low adhesion surface coatings are thermally stable, thereby providing a low sliding angle in a range from about 1° to about 30°, and a high contact angle from about 40° to about 150° even after exposure to high temperature and pressure. Examples of such high temperatures are those in a range from about 100° C. to about 290° C., such as about 150° C.

The fabrication of decurling devices, for example, the indenter roller, requires a high temperature and the indenter roller is pressed against the opposing elastomer roller at various pressures. Hence, it is desirable for an anti-contamination coating of an indenter roller to withstand these high temperature and various pressure conditions. The stability of the anti-contamination coating described herein at high temperatures and various pressures is compatible with current decurling device fabrication processes.

For example, the anti-contamination coating may be coated onto a stainless steel indenter shaft and cured at high temperature without any degradation. Therefore the resulting indenter roller can prevent ink contamination because ink droplets can roll off the anti-contamination coating surface, leaving behind no residue that could otherwise create image defects on the print substrates.

Compositions and Preparation Methods of the Anti-Contamination Coating

In some embodiments, the anti-wetting, low adhesion surface coating described herein is a reaction product of a reactant mixture that includes at least one triisocyanate and a perfluoropolyether diol compound comprising an ethoxylated spacer.

Suitable triisocyanates include polymeric isocyanates such as those having the general formula:

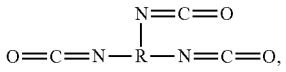

wherein R is an alkyl group, an alkylene group, an aryl group, an arylene group, an arylalkyl group, an arylalkylene group, an alkylaryl group or an alkylarylene group.

In one embodiment, R is an alkyl or an alkylene group including linear and branched, saturated and unsaturated, cyclic and acyclic, and substituted and unsubstituted alkyl and alkylene groups, and wherein heteroatoms, such as oxygen, nitrogen, sulfur, silicon, phosphorus, or the like either may or may not be present in the alkyl or alkylene group.

In one embodiment, the alkyl or alkylene group has at least about 8 carbon atoms. In another embodiment, the alkyl or alkylene group has at least about 10 carbon atoms. In another embodiment, the alkyl or alkylene group has at least about 12 carbon atoms. In one embodiment, the alkyl or alkylene group has no more than about 60 carbon atoms. In another embodiment, the alkyl or alkylene group has no more than about 50 carbon atoms. In yet another embodiment, the alkyl or alkylene group has no more than about 40 carbon atoms. It will be appreciated, however, that the number of carbon atoms can be outside of these ranges.

In one embodiment, R is an aryl or an arylene group (including substituted and unsubstituted aryl and arylene groups, and wherein heteroatoms, such as oxygen, nitrogen, sulfur, silicon, phosphorus, or the like either may or may not be present in the aryl or arylene group).

In one embodiment, the aryl or arylene group has at least about 5 carbon atoms. In another embodiment, the aryl or arylene group has at least about 6 carbon atoms. In one embodiment, the aryl or arylene group has no more than about 50 carbon atoms. In another embodiment, the aryl or arylene group has no more than about 25 carbon atoms. In yet another embodiment, the aryl or arylene group has no more than about 12 carbon atoms. It will be appreciated, however, that the number of carbon atoms can be outside of these ranges.

In one embodiment, R is an arylalkyl or an arylalkylene group (including substituted and unsubstituted arylalkyl and arylalkylene groups, wherein the alkyl portion of the arylalkyl or arylalkylene group can be linear or branched, saturated or unsaturated, cyclic or acyclic, and substituted or unsubstituted, and wherein heteroatoms, such as oxygen, nitrogen, sulfur, silicon, phosphorus, or the like either may or may not be present in either the aryl or the alkyl portion of the arylalkyl or arylalkylene group).

In one embodiment, the arylalkyl or arylalkylene group has at least about 6 carbon atoms. In another embodiment, the arylalkyl or arylalkylene group has at least about 7 carbon atoms. In one embodiment, the arylalkyl or arylalkylene group has no more than about 60 carbon atoms. In another embodiment, the arylalkyl or arylalkylene group has no more than about 40 carbon atoms. In yet another embodiment, the arylalkyl or arylalkylene group has no more than about 30 carbon atoms. It will be appreciated, however, that the number of carbon atoms can be outside of these ranges.

The substituents on the substituted alkyl, alkylene, aryl, arylene, arylalkyl, arylalkylene, alkylaryl, and alkylarylene groups can be (but are not limited to) halogen atoms, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, azo groups, cyanato groups, isocyanato groups, thiocyanato groups, isothiocyanato groups, carboxylate groups, mixtures thereof, or the like, wherein two or more substituents can be joined together to form a ring.

Examples of triisocyanates or their equivalents include triphenyl methane-4,4',4"-triisocynate; Tris(p-isocynatophenyl) thiophosphate; trimethylolpropane trimer of TDI, or the like, isocyanurate trimers of TDI, HDI, IPDI, or the like, and biuret trimers of TDI, HDI, IPDI, or the like, as well as mixtures thereof.

In some embodiments, suitable triisocyanates may be obtained under the name Desmodur® Mondur® or Impranil® for example, Desmodur® N 3300, Desmodur® N 3790, available from Bayer Materials Science, or the like or mixtures thereof.

In some embodiments, the triisocyante is Desmodur® N 3790 is used in the reactant mixture having the structure:

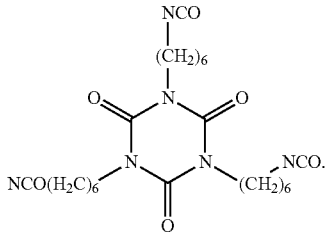

Examples of suitable perfluoropolyether diol compounds comprising an ethoxylated spacer include (but are not limited to) those of the general formula:

$$OH—(CH_2CH_2O)—CH_2—CF_2O—(CF_2CF_2O)_b—(CF_2O)_c—CF_2—CH_2—(CH_2CH_2O)—OH,$$

having a molecular weight of about 500 to about 2000 AMU, such as about 1500 AMU, wherein b and c are integers in range between 0 and 50, provided that at least one of b and c are not zero.

In some embodiments, suitable perfluoropolyether diol compounds may be obtained under the name Fluorolink® E10H, available from Solvay Solexis SpA (Milan, Italy).

Suitable reaction conditions for making the fluorinated polyurethane matrix compounds include crosslinking a perfluoropolyether diol compound comprising an ethoxylated spacer with one or more of the triisocyanates such as Desmodur® 3790 at an elevated temperature, for example, from about 50° C. to about 100° C., such as 71° C. or 72° C., to yield a prepolymer coating solution. In some embodiments, the perfluoropolyether diol compound comprising an ethoxylated spacer is dissolved in a solvent. A catalyst may be optionally used to produce a perfluoropolyether diol polymer solution, which may be heated before mixing the perfluoropolyether diol compound comprising an ethoxylated spacer with the triisocyanate.

The perfluoropolyether diol compound comprising the ethoxylated spacer in some embodiments is more reactive than previous precursors. For example, the perfluoropolyether diol compound comprising the ethoxylated spacer is structurally different from the precursors used in previous coatings, e.g., Fluorolink®-D, which has the structure $HOCH_2CF_2O(CF_2CF_2O)_b(CF_2O)_cCF_2CH_2OH$, wherein b and c are integers as described herein above. This difference generally leads to higher cross-linking in the present composite. In some embodiments, the mixing of the triisocyanate and the perfluoropolyether diol compound comprising the ethoxylated spacer involves different synthesis conditions than in previous embodiments of low adhesion coatings, such as different —OH/—NCO molar ratios and reduced optional reaction catalyst amounts.

The reaction may be carried out in the presence of an optional reaction catalyst, such as dibutyltin dilaurate, bismuth tris-neodecanoate, cobalt benzoate, lithium acetate, stannous octoate, triethylamine, or the like. Other exemplary catalysts include RC catalysts from Rheine Chemie.

In one embodiment, the reaction conditions can be conducted in an inert atmosphere, such as argon or nitrogen gas or other suitable gases, to prevent oxidizing or yellowing of the reaction products and to prevent undesirable side reactions due to moisture.

The reaction can be performed neat (i.e., without a solvent) or can optionally employ any desired or effective solvent. Examples of suitable solvents include xylene, toluene, benzene, chlorobenzene, hexafluorobenzene, nitrobenzene, dichlorobenzene, N-methylpyrrolidinone, dimethyl formamide, dimethyl sulfoxide, sulfolane, hexane, tetrahydrofuran, butyl acetate, amyl acetate, ethyl acetate, propyl acetate, methyl acetate, Hydrofluoroether (HFE) Novec™ 7200 (3M), HFE 7500 (3M), Solvosol (Dow) and the like, as well as mixtures thereof. Another example of a solvent that may be used is FCL 52 solvent, a fluorinated solvent available from Cytonix LLC.

In one embodiment, the anti-contamination coating may be formed on a desired substrate, such as an indenter shaft of a decurling station, by applying an anti-contamination coating being a reactant mixture (solution) that includes at least one triisocyanate and at least one perfluoropolyether-diol compound.

Reactants in the reactant mixture (solution) may be reacted together when the perfluoropolyether dial compound comprising an ethoxylated spacer and the triisocyanates are crosslinked at the elevated temperature described above, e.g. 71° C.-72° C. In some embodiments, the reactant mixture can be further reacted by first curing at a temperature in a range from about 100° C. to about 290° C., for example at 160° C. for a period of time from about 5 minutes to about 1 hours, for example about 5 minutes; followed by a second curing treatment at a temperature in a range from about 100° C. to 290° C., for example, at about 150° C. for a longer period of time than in the first curing, such as from about 30 minutes. In one embodiment, the reactant mixture is first cured at a temperature of about 150° C. for about 5 minutes followed by second curing at the same or higher temperature for the same or longer time to form the anti-contamination coating. The anti-contamination coating may be further subjected to high temperature and possibly elevated pressure, which may result in further curing of the coating.

In one embodiment, the reactant mixture may be applied to a substrate using any suitable method such as flow coating, die extrusion coating, dip coating, spray coating, spin coating, stamp printing, and blade techniques. An air atomization device such as an air brush or an automated air/liquid spray can be used to spray the reactant mixture. The air atomization device can be mounted on an automated reciprocator that moves in a uniform pattern to cover the surface of the substrate with a uniform (or substantially uniform) amount of the reactant mixture. The use of a doctor blade is another technique that can be employed to apply the reactant mixture. In flow coating, a programmable dispenser is used to apply the reactant mixture.

Figure 3:
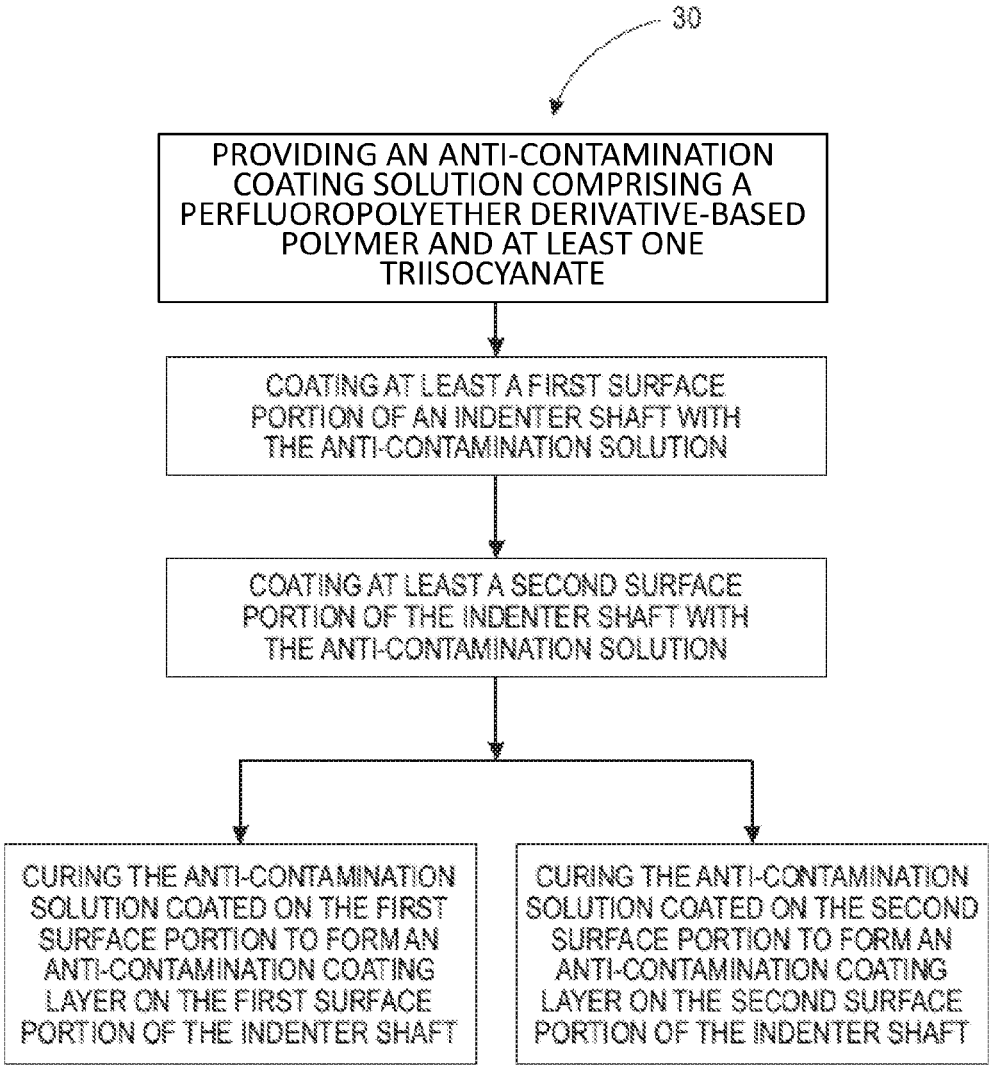
FIG. 3 is a flow chart of a method for making an indenting roller of a decurling device.

FIG. 3 is a flow chart depicting a method for making an indenter roller, such as the indenter roller of embodiments described herein, for example of FIGS. 1A-2C. The method may include providing an anti-contamination coating solution being the reactant mixture (solution) comprising a perfluoropolyether derivative-based polymer and a triisocyanate. The method may also include coating at least a first surface portion of an indenter shaft with the anti-contamination solution. This may include coating at least a second surface portion of the indenter shaft. The anti-contamination solution coated on the first surface and/or the second surface may then be cured. The coating may be formed by any method capable of providing a substantially uniform layer of the anti-contamination coating solution on a surface of the indenter shaft. In an example, the coating may be performed by dip-coating the metal shaft into a prepared volume of the anti-contamination solution.

Aqueous Inks

The aqueous inks which the anti-contamination coating of the embodiments may be brought in contact with, for example, in a print apparatus when a print-substrate on which such aqueous inks are deposited as a print image are fed through a decurling station between an indenter roller and an elastomer roller, may comprise water, colorant and optionally other ingredients such as co-solvents (humectants), surfactants, binders, buffers and biocides. The water acts as a liquid carrier (or medium) for the colorant and optional additives.

The basic components such as the dye or pigment and the aqueous medium that make up the ink composition of the present invention are known per se, and those conventionally used in ink compositions for ink jet recording may be used. For example, the dye may include water-soluble dyes as typified by direct dyes, acid dyes, basic dyes and reactive dyes.

Examples of pigments with coloristic properties useful in aqueous ink jet inks include, but are not limited to: Pigment Blue 15:4; (magenta) Pigment Red 122 Pigment Yellow 14, Pigment Yellow 74, Pigment Orange 5, Pigment Green 1, Pigment Blue 60, Pigment Violet 3, and carbon black, etc.

In conventional ink compositions, dyes are commonly used in such a proportion that the dye holds about 0.1 to 20% by weight in the ink composition. Pigment may also be contained in the ink composition in an amount of 0.1% by weight to 20% by weight based on the total weight of the composition.

The aqueous medium used in the inks used with some embodiments is water, such as deionized water, or a mixture of water and a water-soluble organic solvent. The water-soluble organic solvent used with water may include, for example, lower alcohols such as methyl alcohol, ethyl alcohol, n-propyl alcohol, isopropyl alcohol, n-butyl alcohol, sec-butyl alcohol and tert-butyl alcohol; amides such as dimethylformamide and dimethylacetamide; ketones or ketoalcohols such as acetone and diacetone alcohol; ethers such as tetrahydrofuran and dioxane; polyalkylene glycols such as polyethylene glycol and polypropylene glycol; alkylene glycols such as ethylene glycol, propylene glycol, butylene glycol, diethylene glycol, triethylene glycol, dipropylene glycol, tripropylene glycol, thiodiglycol and hexylene glycol; lower alkyl ethers of polyhydric alcohols, such as ethylene glycol monomethyl ether, ethylene glycol monoethyl ether, diethylene glycol monomethyl ether, diethylene glycol monoethyl ether, diethylene glycol monobutyl ether, triethylene glycol monomethyl ether, triethylene glycol monoethyl ether, and triethylene glycol monobutyl ether; glycerol; 2-pyrrolidone; N-methyl-2-pyrrolidone; and 1,3-dimethyl-2-imidazolidinone. Of these, glycerol, alkylene glycols such as diethylene glycol, and lower alkyl ethers of polyhydric alcohols such as triethylene glycol monoethyl ether may be used in some embodiments.

The water-soluble organic solvent may be contained in the ink composition in an amount of usually from about 0% to about 5% by weight, preferably from about 10% to about 80% by weight, such as from about 20% to 50% by weight, based on the total weight of the ink composition.

When water-soluble organic solvents are used, the content of the water may be determined within a vast range, depending on the type of component of the water-soluble organic solvent, the composition thereof and the desired properties of ink, and may be within the range of usually from about 10% to about 95% by weight, preferably from about 10% to about 70% by weight, and more preferably from about 20% to about 70% by weight, based on the total weight of the ink composition.

Commonly, surfactants are added to the ink to adjust surface tension and wetting properties. Suitable surfactants include ethoxylated acetylene diols (e.g. Surfynols® series from Air Products), ethoxylated primary (e.g. Neodol® series from Shell) and secondary (e.g. Tergitol® series from Union Carbide) alcohols, sulfosuccinates (e.g. Aerosol® series from Cytec), organosilicones (e.g. Silwet® series from Witco) and fluoro surfactants (e.g. Zonyl® series from DuPont). Surfactants are typically used in amounts up to about 5% and more typically in amounts of no more than 2%.

Inclusion of sequestering (or chelating) agents such as ethylenediaminetetraacetic acid (EDTA), iminodiacetic acid (IDA), ethylenediamine-di(o-hydroxyphenylacetic acid) (EDDHA), nitrilotriacetic acid (NTA), dihydroxyethylglycine (DHEG), trans-1,2-cyclohexanediaminetetraacetic acid (CyDTA), dethylenetriamine-N,N,N',N",N"-pentaacetic acid (DTPA), and glycoletherdiamine-N,N,N',N'-tetraacetic acid (GEDTA), and salts thereof, may be advantageous, for example, to eliminate deleterious effects of heavy metal impurities.

Biocides may be used to inhibit growth of microorganisms in the aqueous inks. The biocides may be anti-microbial agents, anti-fungal agents, etc. Polymers may also be added to the ink to improve durability, or other properties.

Suitable commercial aqueous inks for use with some embodiments of the anti-contamination coatings, indenter rollers, decurling devices and methods described herein include Collins Y, C, M and K dye and pigment inks (Collins Ink jet Corporation, Cincinnati, Ohio) and WBKC Prodigy™ inks (INX Digital International, San Leandro, Calif.) Hunts MICR (Hunt Imaging™, Berea, Ohio) and Arte Belle C pigment ink (American Ink Jet Corporation, Billerica, Mass.

Specific embodiments will now be described in detail. These examples are intended to be illustrative, and the claims are not limited to the materials, conditions, or process parameters set forth in these embodiments.

EXAMPLES

Example 1A

Preparation of Anti-Contamination Coating 38.3 grams of Fluorolink® E10H was added to a 3 neck round bottom flask fitted with an addition funnel, a temperature probe and a condenser. 245 mL of Novec™ 7200, 170 mL of ethyl acetate and 0.333 grams of dibutyltin dilaurate catalyst were added to the 3 neck round bottom flask, and the contents were stirred and heated to a gentle reflux (~71° C.) under a nitrogen atmosphere. A second solution was prepared by dissolving 11.6 grams of Desmodur® 3790 in 445 mL of ethyl acetate and 145 mL of Novec™ 7200. This triisocyanate solution was then transferred to the addition funnel connected to the round bottom flask, and was added dropwise to the Fluorolink® E10H solution over a 2-hour period at 71° C.-72° C. The resulting reactant mixture was stirred overnight (about 18 hours). After cooling to room temperature, the product solution was filtered using a Millipore Opticap® XL filter (pore size 0.2 microns) to yield the product solution. The solid concentration of the product solution was ~4-5%.

Example 1B

Contact Angles and Sliding Angles

Contact angles and sliding angles of aqueous ink on the coating prepared according to Example 1A were assessed on an OCA20 goniometer from Dataphysics. In a typical static contact angle measurement, about 10 microliters of aqueous ink were gently deposited on the surface of the Example 1A coating and the static angle was determined by the computer software (SCA20). Each reported datum is an average of >5 independent measurements.

Sliding angle measurement was done by tilting the base unit at a rate of 1°/sec with an about 10 microliter droplet aqueous ink from Collins ink jet Corporation, Cincinnati, Ohio. The sliding angle is defined as the inclination angle at which the test drop began to slide.

Table 1, below, depicts the values of the contact angle (CA) and sliding angle (SA) of six samples of the anti-wetting low adhesion aqueous coating according to Example 1A after initial curing. As is evident from the Table, all of contact angle values were above 40° and the sliding angle values were less than 30°.

TABLE 1

| Sample ID | CA[a] | SA[b] |
|---|---|---|
| 1 | 60 | 13 |
| 2 | 62 | 27 |
| 3 | 62 | 24 |
| 4 | 65 | 22 |
| 5 | 61 | 20 |
| 6 | 62 | 18 |

[a]CA refers to Contact Angle
[b]SA refers to Sliding Angle

Figure 4:
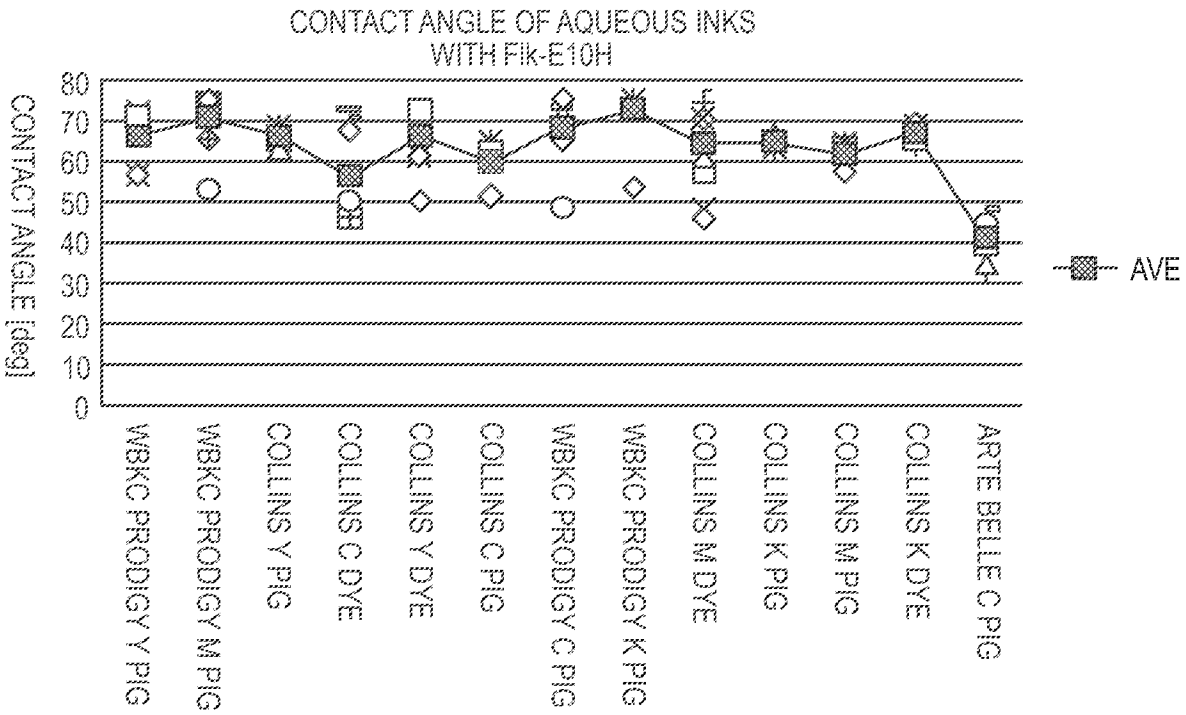
FIG. 4 is a graph providing contact angles using commercially available aqueous inks.

The anti-wetting low adhesion coating described in Example 1 was also tested with thirteen commercial aqueous inks and the sliding and contact angles of the inks on the coating were evaluated. As shown in FIG. 4, all of the commercial inks exhibited contact angles greater than 40° C. on average. Collins Y, C, M and K dye and pigment inks (Collins Ink jet Corporation, Cincinnati, Ohio) and WBKC Prodigy™ inks (INC Digital International, San Leandro, Calif.) resulted in higher contact angles than Arte Belle C pigment ink (American Ink Jet Corporation, Billerica, Mass.).

Example 2A

Preparation of Anti-Contamination Coating

A similar method for preparing the anti-contamination coating as in Example 1A was followed except that the solid concentration of the product solution was 10%.

Example 2B

Dip-Coating Indenter Shaft with Anti-Contamination Coating

A 100 ml graduated cylinder was partially filled with the FLUOROLINK®-E10H coating solution prepared in Example 1A. A first portion of a stainless-steel indenter shaft (18" length, 6 mm diameter) was dipped into the solution and remained in the solution for ~1 minute (a second portion of the shaft remained un-immersed). The indenter shaft was slowly removed from the solution and allowed to air dry for ~2 minutes. A layer of FLUOROLINK®-E10H was observed to be disposed on a first surface portion of the indenter shaft. The first portion of the stainless steel indenter shaft with FLUOROLINK®-E10H layer on the surface was placed in an oven and cured at a temperature of about 150° C. for 5 minutes. The process was repeated with the second portion of the stainless-steel indenter shaft. A final curing was performed in an oven at a temperature of 150° C. curing for 30 minutes.

Example 3

Long-Run Ink Buildup

Ink level contamination and ink offset data was gathered for print runs in which indenter rollers of various configurations were used in a printing apparatus. The indenter rollers that were tested included an indenter roller prepared according to Example 2B and other indenter rollers were tested, including only a stock stainless-steel indenter shaft, a shaft coated with "Ultra-Kote", one with "Tech-Coat" and another with an electroless nickel coating. A run of 10,000 sheets was performed for each with a print output comprising a 1"×10" printed stripe of 200% AC ink (100% K+33% CMY).

Relative ink offset levels were ranked with relative numeric results listed in Table 2 below (lower numeric ranking corresponds to less ink contamination, i.e., more of the ink on the printed stripe remained on the paper instead of contaminating the indenter roller).

TABLE 2

| Indenter Roller Coating | Ranking |
|---|---|
| None (stock indenter) | 2 |
| Ultra-Kote | 1 |
| Tech-Coat | 2 |
| Electroless Nickel | 1.5 |
| Fluorolink ® E10H | 0.5 |

As shown in Table 1, the indenting roller comprising a Fluorolink® E10H anti-contamination coating provided the best results, with acceptable levels of ink contamination.

While the embodiments have been illustrated respect to one or more implementations, alterations and/or modifications can be made to the illustrated examples without departing from the spirit and scope of the appended claims. In addition, while a particular feature of the embodiments may have been disclosed with respect to only one of several implementations, such feature may be combined with one or more other features of the other implementations as may be desired and advantageous for any given or particular function.

Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments will be apparent to those skilled in the art from consideration of the specification and practice of the descriptions disclosed herein. It is intended that the specification and examples be considered as exemplary only, with a true scope and spirit of the embodiments being indicated by the following claims.

What is claimed is:

1. A printing apparatus, comprising:

a sheet path for moving a print substrate;

a decurling station positioned along the sheet path, the decurling station comprising:

an indenting roller mounted for rotation around a first longitudinal axis thereof and on a first side of the sheet path, the indenting roller comprising an indenter shaft and an anti-contamination coating disposed on the indenter shaft, wherein a drop of aqueous ink exhibits a sliding angle of from about 18° to about 30° and a contact angle of greater than about 40° with a surface of the anti-contamination coating; and an elastomeric roller mounted for rotation around a second longitudinal axis thereof and on a second side of the sheet path, wherein the anti-contamination coating comprises a reaction product of more than one triisocyanates and a perfluoropolyether diol compound comprising an ethoxylated spacer.

2. The apparatus of claim 1, wherein the more than one triisocyanate comprises a mixture of triisocyanates selected from the group consisting of triphenyl methane-4,4',4"-triisocynate; Tris(p-isocynatophenyl) thiophosphate; trimethylolpropane trimer of TDI, isocyanurate trimers of TDI, and biuret trimers of TDI, HDI, and IPDI.

3. The apparatus of claim 1, wherein the contact angle is greater than about 55°.

4. The apparatus of claim 1, wherein the sliding angle is from about 18° to about 20°.

5. The apparatus of claim 1, wherein a drop of aqueous ink exhibits a sliding angle of from 18° to 30° with a surface of the anti-contamination coating and a contact angle of greater than 40° with the surface of the coating after curing, wherein the curing comprises a curing treatment at a temperature of between about 100° C. and about 290° C. for a period of about 5 minutes to about 35 minutes.

6. The apparatus of claim 1, wherein the perfluoropolyether diol compound has a general formula:

$$OH—(CH_2CH_2O)—CH_2—CF_2O—(CF_2CF_2O)_b—(CF_2O)_c—CF2\text{-}CH_2—(CH_2CH_2O)—OH,$$

having a molecular weight of about 1500 AMU, and wherein b and c are integers in range between 0 and 50.

7. The apparatus of claim 6, wherein a first triisocyanate of the more than one triisocyanates is represented by the following generic structure:

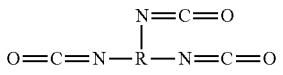

wherein R may be a cyclic, an aromatic, an aliphatic, a linear, a branched isocyanurate, a biuret triisocyanate, or a substituted hydrocarbon moiety comprising from about 1 to about 20 carbon atoms.

8. The apparatus of claim 7, wherein the first triisocyanate is:

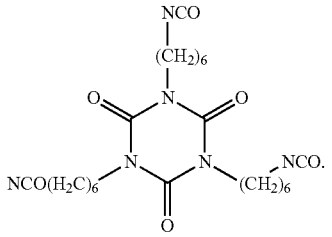

9. The apparatus of claim 1, wherein the anti-contamination coating comprises a thickness in the range of from about 1 μm to about 50 μm.

10. The apparatus of claim 1, wherein at least one of the indenting roller and the elastomeric roller are configured to be moveable so as to engage one another.

11. The apparatus of claim 1, wherein the indenter shaft comprises stainless steel.

12. The apparatus of claim 1, wherein the print substrate comprises a printed image on a surface thereof and the indenting roller is arranged to contact the printed image.

13. A method of making an indenting roller of a decurling device, comprising:

providing an anti-contamination coating solution;

depositing the anti-contamination coating solution on a surface of an indenter shaft; and curing the anti-contamination coating solution deposited on the surface of the indenter shaft to form an anti-contamination coating, wherein a drop of aqueous ink exhibits a sliding angle of from about 18° to about 30° and a contact angle of greater than 40° with a surface of the cured anti-contamination coating, wherein the anti-contamination coating solution comprises more than one triisocyanates and a perfluoropolyether diol compound comprising an ethoxylated spacer, and wherein the curing of the anti-contamination coating solution comprises reacting the more than one triisocyanates and the perfluoropolyether diol compound comprising the ethoxylated spacer, and wherein the anti-contamination coating comprises a reaction product of the more than one triisocyanates and the perfluoropolyether diol compound comprising the ethoxylated spacer.

14. The method of claim 13, wherein the more than one triisocyanate comprises a mixture of triisocyanates selected from the group consisting of triphenyl methane-4,4',4"-triisocynate; Tris(p-isocynatophenyl) thiophosphate; trimethylolpropane trimer of TDI, isocyanurate trimers of TDI, and biuret trimers of TDI, HDI, and IPDI.

15. The method of claim 13, wherein the curing of the anti-contamination coating solution comprises at least one curing treatment at a temperature of between about 100° C. and about 290° C. for a period of about 5 minutes to about 35 minutes.

16. The method of claim 13, wherein the depositing comprises dip-coating the indenter shaft with the anti-contamination coating solution.

17. The method of claim 13, wherein the perfluoropolyether diol compound has a general formula:

$$OH—(CH_2CH_2O)—CH_2—CF_2O—(CF_2CF_2O)_b—(CF_2O)_c—CF2\text{-}CH_2—(CH_2CH_2O)—OH,$$

having a molecular weight of about 1500 AMU, and wherein b and c are integers in range between 0 and 50.

18. The method of claim 17, wherein a first triisocyanate of the more than one triisocyanates is represented by the following generic structure:

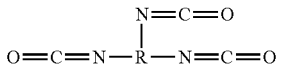

wherein R may be a cyclic, an aromatic, an aliphatic, a linear, a branched isocyanurate, a biuret triisocyanate, or a substituted hydrocarbon moiety comprising from about 1 to about 20 carbon atoms.

19. The method of claim 18, wherein the first triisocyanate is:

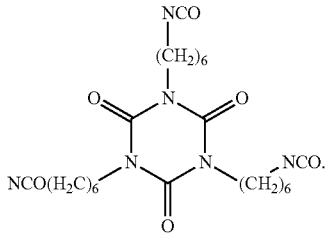

20. An indenting roller, comprising:

an indenter shaft and an anti-contamination coating disposed on a surface of the indenter shaft, wherein a drop of aqueous ink exhibits a sliding angle of from about 18° to about 30° and a contact angle of greater than about 40° with a surface of the anti-contamination coating, wherein the anti-contamination coating comprises a reaction product of more than one triisocyanates and a perfluoropolyether diol compound comprising an ethoxylated spacer.

* * * * *